United States Patent [19]

Rhodes et al.

[11] 4,373,418

[45] Feb. 15, 1983

[54] TUNING FORK MOUNTING ASSEMBLY IN ELECTROMECHANICAL PIANOS

[75] Inventors: Harold B. Rhodes, La Habra; Steven J. Woodyard, Stanton, both of Calif.

[73] Assignee: CBS Inc., New York, N.Y.

[21] Appl. No.: 223,777

[22] Filed: Jan. 9, 1981

[51] Int. Cl.[3] ..... G10D 13/08; G10H 3/00

[52] U.S. Cl. ..... 84/404; 84/1.15; 84/408

[58] Field of Search ..... 84/402–405, 84/408, 1.04, 1.14–1.15

[56] References Cited

U.S. PATENT DOCUMENTS

| | | | |
|---|---|---|---|
| 2,456,321 | 12/1948 | Rhodes | 84/404 |
| 2,469,667 | 5/1949 | Rhodes | 84/404 |
| 2,972,922 | 2/1961 | Rhodes | 84/1.15 |
| 3,270,608 | 9/1966 | Rhodes | 84/237 |
| 3,285,116 | 11/1966 | Rhodes | 84/176 |
| 3,384,699 | 5/1968 | Rhodes | 84/1.14 |
| 3,418,417 | 12/1968 | Rhodes | 84/1.15 |
| 3,633,453 | 1/1972 | Musser | 84/403 |
| 3,644,656 | 2/1972 | Fender et al. | 84/1.04 |
| 3,731,580 | 5/1973 | Suzuki | 84/403 |
| 4,205,583 | 6/1980 | Absmann | 84/433 |

*Primary Examiner*—L. T. Hix
*Assistant Examiner*—Thomas H. Tarcza
*Attorney, Agent, or Firm*—Gausewitz, Carr, Rothenberg & Edwards

[57] ABSTRACT

An electromechanical piano of the type incorporating asymmetrical tuning forks. To increase vastly the dwell of the forks in the high-pitched range of the piano, a fork-mounting construction is employed wherein only a single screw is associated with each fork. Elastomeric means are provided around each screw and also between opposed edge surfaces of adjacent forks, whereby to prevent rotation of each fork about the axis of its associated mounting screw.

15 Claims, 5 Drawing Figures

TUNING FORK MOUNTING ASSEMBLY IN ELECTROMECHANICAL PIANOS

BACKGROUND OF THE INVENTION

It has for decades been recognized (Rhodes U.S. Pat. No. 2,972,922) that in an electromechanical piano of the asymmetrical tuning-fork type, there should be a high degree of isolation of each fork from the underlying support. However, how to achieve such isolation while still creating enough support that the instrument may be highly portable—for example in the automobiles of professional musicians—has been the subject of much research. For example, the ultimate compromise between isolation and adequate support was thought to have been achieved (Rhodes U.S. Pat. No. 3,384,699, FIGS. 14 and 15) by cantilevering the high-mass leg of the fork through use of two spaced screws and associated resilient means. Such a manner of mounting remains the ultimate in the great majority of tuning forks of each piano, but a distinct problem exists relative to the high-pitched forks. This problem is dwell time, or "sustain". At the high end of an eighty-eight key electromechanical piano, or even of a seventy-three key electromechanical piano, the dwell or sustain is only a small fraction of a second after the low-mass tine or reed has been struck by the hammer.

There exists a major need to increase this dwell time to a second or more while still maintaining sufficient ruggedness to permit the instrument to be shipped from the factory to the dealer, and also transported from place to place throughout the lifetime of the instrument.

SUMMARY OF THE INVENTION

In accordance with the present invention, there is provided an electromechanical piano wherein at least the high-pitched asymmetrical tuning forks are mounted by means of one screw only, and each such screw has associated therewith a resilient means effective not only to support the fork but to prevent rotation thereof about the axis of the single screw. Dwell is thereby vastly increased, yet ruggedness and transportability are not sacrificed.

Stated more specifically, the mount for each fork comprises a block of relatively soft elastomer through which the mounting screw extends, and such elastomer extends upwardly into the space between two adjacent forks to thereby prevent rotation of any fork about its associated screw. An elastomeric grommet is provided above the fork and below the screw head, and furthermore extends through each fork and into the block of elastomer. The result is a simple, effective, construction which achieves surprisingly great dwell in addition to mass-producibility and transportability.

DETAILED DESCRIPTION OF THE PREFERRED EMBODIMENT

Figure 1:
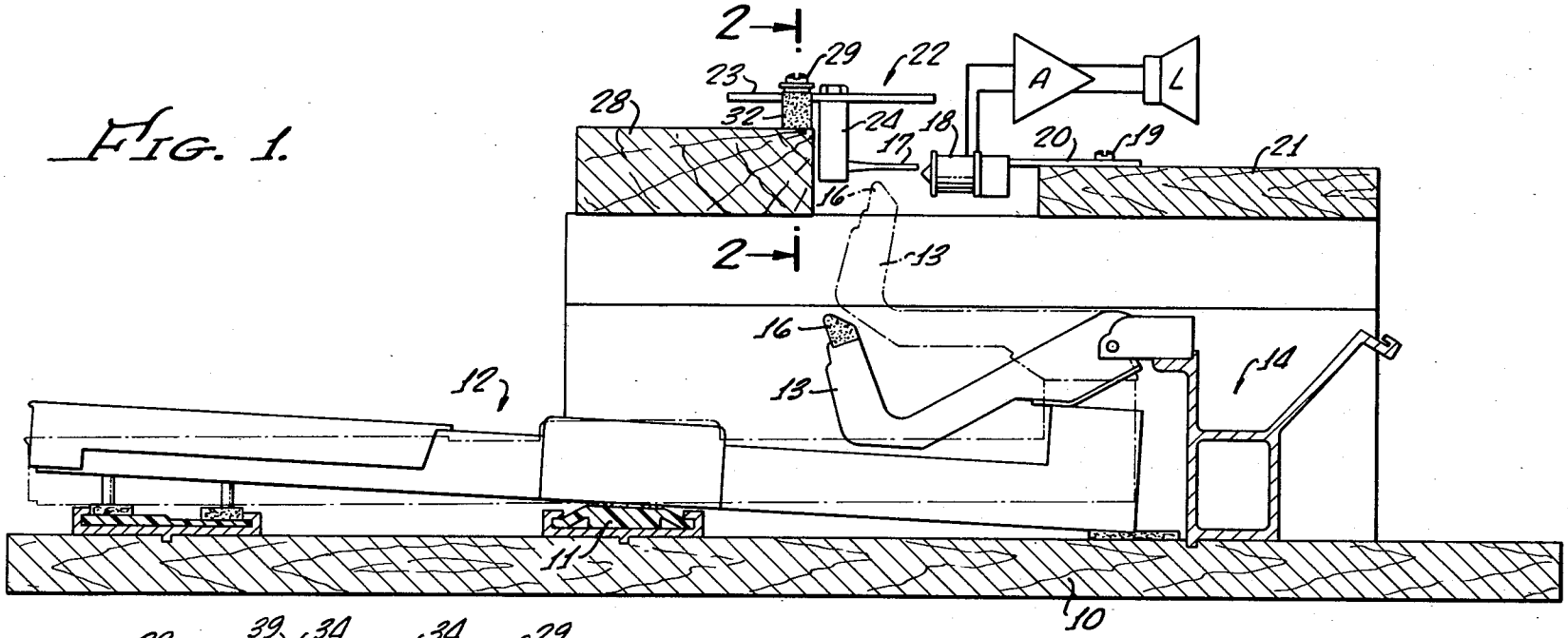
FIG. 1 is a vertical, sectional view illustrating an electromechanical piano incorporating the present invention.

Referring first to FIG. 1, this is a vertical, sectional view depicting one piano action, asymmetrical tuning fork, and mechanical-electrical transducer, it being understood that there are many such assemblies disposed adjacent each other in each piano. (U.S. Pat. No. 2,972,922 is incorporated by reference herein.)

Stated more definitely, an underlying support 10 has mounted thereon for pivotal motion at region 11 a piano key 12. Downward pressing on the outer (left) portion of key 12 effects upward movement of the inner portion thereof and thereby causes clockwise pivotal movement of a hammer 13, such hammer being mounted on an extrusion 14 supported on element 10. (For further description of the piano action, U.S. Pat. No. 4,205,583 is incorporated by reference herein.)

Hammer 13 of each piano action preferably has a tip 16 formed of rubber or other suitable elastomer. This tip flies upwardly in response to striking of the piano key and engages a low-mass tine or reed 17 to thus set the same into vibration. The vibrations are transduced by an electromagnetic coil 18 (or other suitable mechanical-electrical transducer) disposed adjacent the end of the tine. The coil is connected to suitable amplifier and loudspeaker means, shown at A and L. It is mounted by means of a screw 19 and mounting bar 20 on a support 21.

Figure 4:
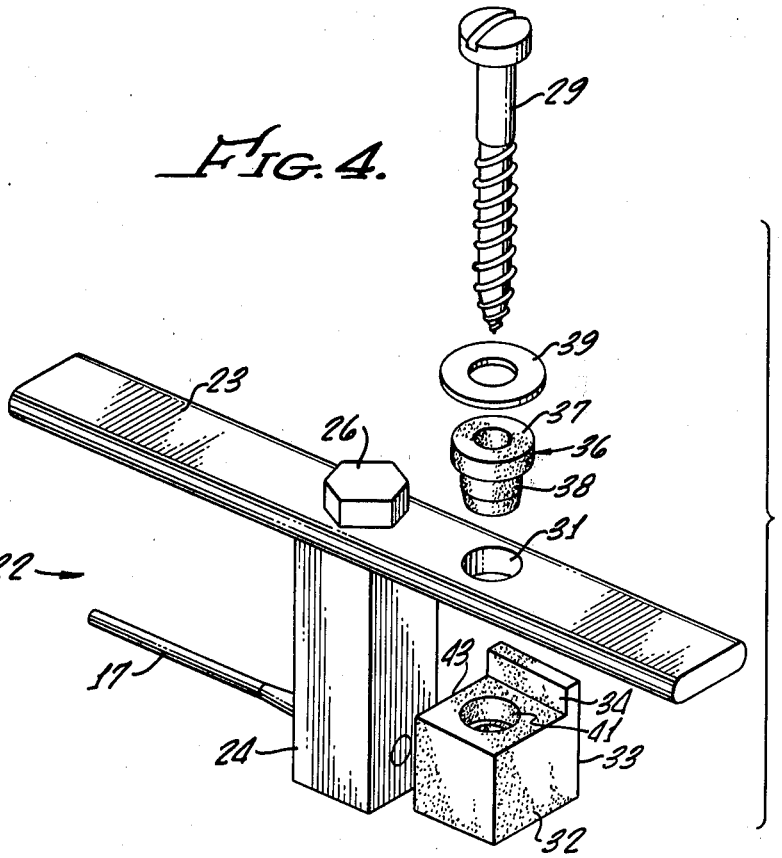
FIG. 4 is an exploded isometric view of one asymmetrical tuning fork assembly and associated mount.

As best shown in FIG. 4, tine 17 is the low-mass leg of an asymmetrical tuning fork 22. The high-mass leg of such fork is the left region (FIG. 4) of a steel bar 23, and the right portion (FIG. 4) of such bar is the base of the fork and forms part of the mounting assembly to be described below. The two legs of the fork are rigidly connected to each other by a short steel bar 24 generally termed a tone bar. Bar 24 is tightly connected to bar 23 by a cap screw 26. The base of tine 17 (the right end thereof as viewed in FIG. 4) is driven to an opening in bar 24 in tightly force-fit relationship. (For further description of the asymmetrical tuning fork with plural components, U.S. Pat. No. 3,418,417 is incorporated by reference herein.)

Tine 17 is tuned or resonated to the left end of bar 23 as viewed in FIG. 4. Furthermore, in the illustrated asymmetrical fork, the tine 17 is very short. It thus vibrates through only a very small amplitude and generates a high frequency of vibration and high pitch. As an example, the particular fork shown in FIGS. 1 and 4 may have a tine 17 which protrudes outwardly from the left face (FIG. 4) of bar 24 a distance slightly less than one inch, whereas the portion of bar 23 thereabove protrudes from the same face slightly more than one inch. The pitch thus generated is, for example, a high "B". The fork is, for example, the seventy-fifth tone generator (counting from the bottom) of an eighty-eight key piano.

There will now be described the means for mounting each asymmetrical fork 22 (particularly the high-pitched forks) on a wooden support element 28, in such manner as to achieve a relatively long vibration of tine 17, yet without permitting the fork to be jarred out of place in response to shipment or playing of the instrument. The mounting means comprises a wood screw 29 driven downwardly into support 28. The shank portion of each screw is much smaller in diameter than is a hole 31 in the base or mounting portion of bar 23. Thus, the screw extends downwardly through hole 31 without contacting bar 23. The screw also extends through an elastomeric block 32, which may be rubber or a suitable synthetic rubber. As a preferred example, the block may be a synthetic sold by DuPont Corporation under the trademark "CLORPRENE". Block 32 is relatively soft, preferably having a hardness of about 30 durometer.

Figure 2:
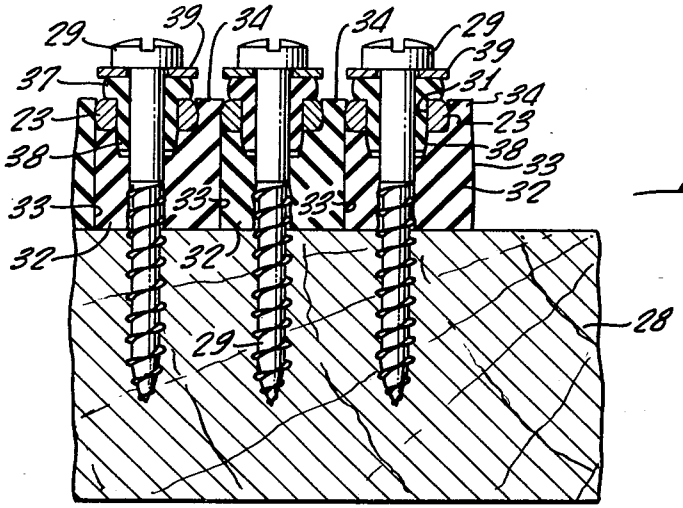
FIG. 2 is an enlarged fragmentary, sectional view taken on line 2—2 of FIG. 1.

Accordingly, as best shown in FIG. 2, a plurality of such elastomeric blocks are disposed side by side on the upper surface of support 28, each such block engaging and supporting the underside of a bar 23 in the vicinity of hole 31. One vertical face of each block is disposed generally beneath one edge of the associated bar 23. The other vertical face of such block is not generally beneath the other edge, being instead spaced laterally therefrom (for example, to the right as shown in FIG. 2.) The last-mentioned face, indicated by the reference numeral 33 in FIG. 2, does not terminate at the bottom of bar 23, but instead extends upwardly, preferably to the top of such bar. Thus, the upper region of face 33 is one side of a flange 34, which is formed on each block 32, and preferably integrally therewith. The flange 34 need not be continuous, but can instead incorporate spaced portions.

Figure 3:
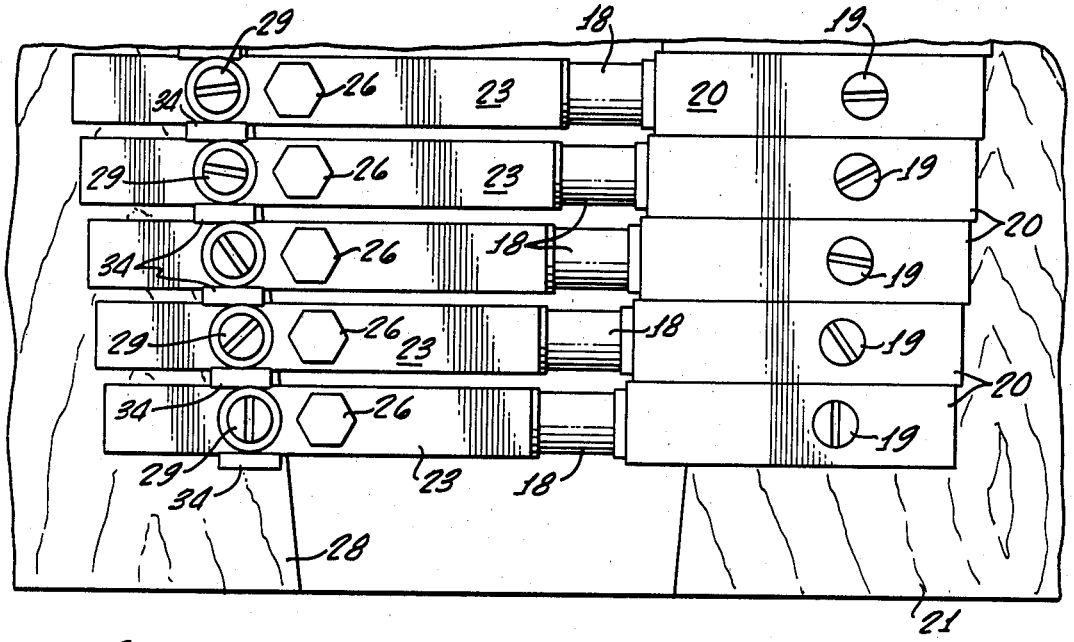
FIG. 3 is a fragmentary top plan view of the right portion of FIG. 1.

As illustrated at the upper-middle region of FIG. 2, as well as at the left in FIG. 3, each flange 34 is dimensioned to fit between adjacent edges of bars 23. It follows that the tendencies of the bars 23 to rotate about screws 29—for example in response to shocks which occur during shipment—are prevented by the flanges 34 which in turn are supported by the adjacent vertical side edges of adjacent bars 23. Stated in another manner, the bars 23 prevent each other from rotating about their associated screws 29 due to the interposition of the flanges 34 between the bar edges.

It is emphasized that the flanges 34, being formed of soft elastomeric material, do not transmit substantial vibrations from one asymmetrical fork to the next, this being desirable in preventing interaction of adjacent forks.

Figure 5:
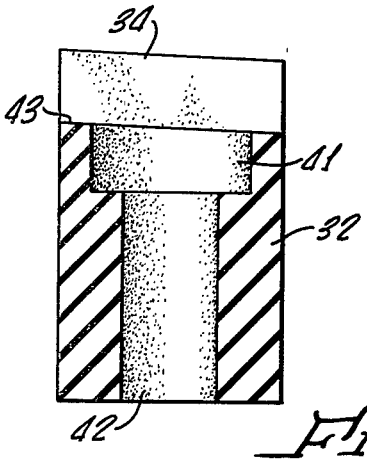
FIG. 5 is a cross-sectional view of one of the elastomeric blocks incorporated in the mounting assembly.

Proceeding now to further discussion of the fork-mounting means, a soft elastomeric grommet 36, having a flange portion 37 and smaller-diameter body portion 38, is associated with bar 23 at hole 31. It is also associated with the upper region of each block 32. Thus, flange 37 seats between the upper surface of each bar 23 and a metal washer 39 disposed below the head of screw 29. The body 38 of each grommet extends downwardly through hole 31 and into a recess 41 in the upper side of block 32. The grommet is disposed around screw 29 in engagement therewith, and also in engagement with the inner wall of hole 31. The region of grommet body 38 below bar 23 engages the inner wall of recess 41, and is illustrated as slightly tapered. Screw 29 extends through the grommet and also through a bore or passage 42 formed in elastomeric block 32 beneath recess 41 and coaxially therewith, reference being made to FIG. 5.

The upper edge of that face of block 32 which is relatively adjacent bar 24 is numbered 43, and is preferably somewhat above the edge remote from bar 24. Thus, the upper surface of block 32 is preferably not perfectly horizontal but instead somewhat inclined, the direction of incline being upwardly toward the vibrating portions of the fork. This incline compensates for the weight of elements 23, 24 and 17, and causes the bar 23 to be horizontal despite the fact that block 23 is soft and there is only one screw 29.

Each asymmetrical tuning fork is mounted on element 28 in a very rapid manner during mass production. This is accomplished by disposing grommet 36 in hole 31, and driving screw 29 (which has the washer 39 adjacent its head) downwardly through grommet 36 and block 32 into the support 28. The degree of tightening of screw 29 is only barely sufficient to compress the block 32 a slight amount, and sufficient to prevent undesired tilting of bar 23 but instead (in combination with the elevated edge 43) to cause such bar to be substantially horizontal as desired.

The word "screw" in the present specification and claims is descriptive of the preferred form, it being understood that other fasteners may be employed.

The foregoing detailed description is to be clearly understood as given by way of illustration and example only, the spirit and scope of this invention being limited solely by the appended claims.

We claim:

1. In an electromechanical piano of the type in which each tone is generated by striking the low-mass leg of an asymmetrical fork, and the resulting vibrations of such leg are transduced into a voltage adapted to be amplified and used to drive a loudspeaker, an improved mounting means for each such fork, said mounting means comprising:

(a) a single screw extended through an oversize opening in a high-mass portion of said fork and thence into a support, (b) resilient means to maintain said high-mass portion in spaced relationship from said support without effecting substantial damping of said fork, (c) means to prevent said fork from rotating about the axis of said screw, said means (c) being spacer or standoff means interposed between said fork and the fork adjacent thereto for contact with high-mass portions of both forks, the single screw for each fork cooperating with the screw of the adjacent fork, and also with high-mass portions of both forks and with spacer or standoff means, to prevent rotation of each fork about the axis of its associated screw, and (d) characterized in that said means (a) and (b) constitute the sole support for said fork, and said means (c) constitutes the sole means for preventing each fork from rotating about the axis of its associated screw.

2. The invention as claimed in claim 1, in which said means (c) is disposed adjacent said opening, and is between the base portions of adjacent forks.

3. The invention as claimed in claim 1, in which said means (b) is formed of relatively soft elastomeric material.

4. The invention as claimed in claim 3, in which said means (c) is formed of relatively soft elastomeric material.

5. The invention as claimed in claim 4, in which said means (c) is integral with said means (b).

6. The invention as claimed in claim 1, in which soft spacer means are interposed between the exterior surface of said screw and the wall of said opening.

7. The invention as claimed in claim 6, in which said soft means is the body portion of an elastomeric grommet, said grommet having a flange interposed between said high-mass fork portion and the head of said screw.

8. The invention as claimed in claim 7, in which said resilient means (b) is a mass of relatively soft elastomeric material, said mass having a recess in the upper portion thereof, and in which said body of said grommet extends downwardly into said recess.

9. The invention as claimed in claim 1, in which said fork is a tuning fork wherein the high-mass and low-mass legs are tuned or resonated to each other.

10. The invention as claimed in claim 1, in which said low-mass leg is a short tine adapted to vibrate at a relatively high frequency near the upper end of the range of the piano.

11. The invention as claimed in claim 1, in which said tuning fork and associated mounting means is combined with a piano action, with a transducer, and with amplifier and loudspeaker means.

12. The invention as claimed in claim 1, in which said resilient means (b) is a block of soft elastomeric material, and said means (c) is an integral flange on said means (b), said flange extending between opposed surfaces of adjacent high-mass portions of adjacent forks, and being in contact with said opposed surfaces.

13. The invention as claimed in claim 1, in which said screw is extended sufficiently into the support to compress said resilient means (b) slightly, whereby to operate in cooperation with said means (c) to provide stability for the fork without effecting substantial damping of vibrations thereof.

14. An electromechanical piano incorporating both vibratory means and electronic means to generate the desired sounds, said piano comprising:

(a) a piano action, (b) a vibratory element adapted to vibrate in response to striking of a portion thereof by the hammer of said action, (c) means to sense the resulting vibrations, (d) means to mount said vibratory element in a manner sufficiently rugged to withstand shipments but without effecting excessive damping thereof, said means comprising:

only one screw extended through said vibratory element and connecting to a support, a mass of elastomeric material disposed around said screw between said support and said vibratory element to maintain the latter spaced away from said support, spacer or standoff means associated with said mass of elastomeric material and interposed between the vibratory elements for adjacent piano keys, said spacer or standoff means being adapted to engage edge regions of said vibratory elements at such locations, adjacent said screw, as to prevent substantial pivotal movement of said vibratory elements about their respective single screws, and (e) characterized in that said screw and said mass of elastomeric material constitute the sole support for said fork, and said spacer or standoff means constitute the sole means for preventing each fork from rotating about the axis of its associated screw.

15. The invention as claimed in claim 14, in which said spacer or standoff means is a flange integral with said block of elastomeric material and formed of the same material.

* * * * *